US006453559B1

(12) United States Patent
Marshall et al.

(10) Patent No.: US 6,453,559 B1
(45) Date of Patent: Sep. 24, 2002

(54) SAFETY KNIFE

(76) Inventors: Peter Jonathan Marshall, 20A Station Road, Yate, Bristol BS37 4PS (GB); William Alfred Ireland, 257 Pirton Lane, Churchdown, Gloucestershire GL3 2QJ (GB)

( * ) Notice: Subject to any disclaimer, the term of this patent is extended or adjusted under 35 U.S.C. 154(b) by 0 days.

(21) Appl. No.: 09/519,600

(22) Filed: Mar. 6, 2000

(30) Foreign Application Priority Data

Mar. 6, 1999 (GB) ..... 9905122

(51) Int. Cl.[7] ..... B26B 3/04; B26B 29/02

(52) U.S. Cl. ..... 30/2; 30/286; 30/287; 30/152

(58) Field of Search ..... 30/162, 286, 2, 30/293, 294, 279.2, 285, 287

(56) References Cited

U.S. PATENT DOCUMENTS

| | | | | |
|---|---|---|---|---|
| 2,376,887 | A | * | 5/1945 | Walters |
| 2,730,800 | A | * | 1/1956 | Bailey |
| 3,943,627 | A | * | 3/1976 | Stanley, Jr. |
| 4,012,836 | A | * | 3/1977 | Baer et al. |
| 4,086,698 | A | | 5/1978 | Sparks |
| 4,091,537 | A | | 5/1978 | Stevenson, Jr. |
| 4,241,500 | A | * | 12/1980 | Iten |
| 4,473,076 | A | * | 9/1984 | Williams et al. |
| 4,503,612 | A | | 3/1985 | Davis |
| 4,569,133 | A | * | 2/1986 | Schmidt |
| 4,757,612 | A | * | 7/1988 | Peyrot |
| 5,010,648 | A | * | 4/1991 | Takigawa |
| 5,241,750 | A | | 9/1993 | Chomiak |
| 5,620,454 | A | * | 4/1997 | Pierce et al. |
| 5,878,501 | A | * | 3/1999 | Owens et al. |
| 6,195,896 | B1 | * | 3/2001 | Ireland |
| 6,233,832 | B1 | * | 5/2001 | Berns |

FOREIGN PATENT DOCUMENTS

| | | |
|---|---|---|
| DE | 3116354 A1 | 11/1982 |
| EP | 0963820 A1 | 12/1999 |
| GB | 2338444 A | 12/1999 |
| WO | WO9907525 | 2/1999 |

* cited by examiner

*Primary Examiner*—Boyer Ashley
*Assistant Examiner*—Thomas J. Druan, Jr.
(74) *Attorney, Agent, or Firm*—Young & Thompson

(57) ABSTRACT

A safety knife comprises a handle and a blade mounted on the handle so that a part of the blade projects from the handle. Two retractable safety guards are also mounted on the handle, overlying opposite sides of the projecting portion of the blade. Each guard is spring-loaded so that pressure from the material being cut causes the guards to retract into the handle as the blade cuts into the material. A manually controlled locking device normally prevents the guards being retracted but, when operated, allows the guards to retract. The guards automatically extend, under the action of springs, when the knife is removed from the material.

22 Claims, 4 Drawing Sheets

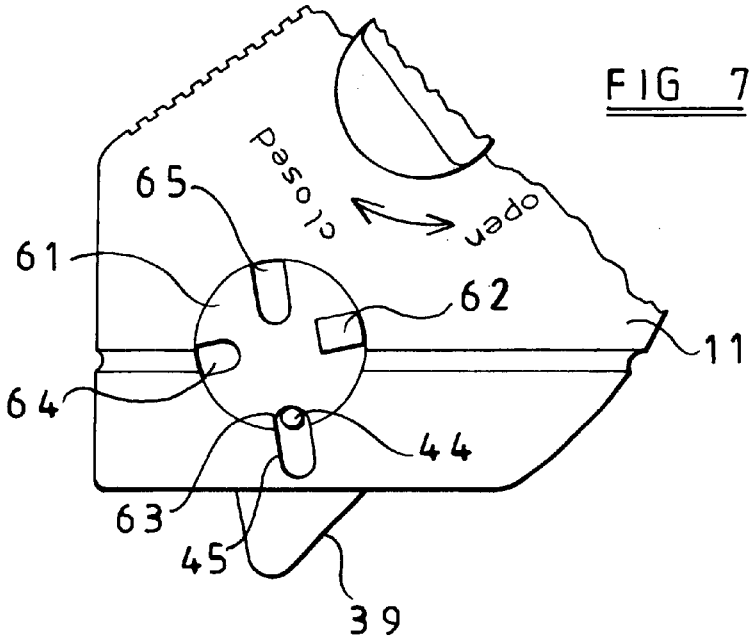
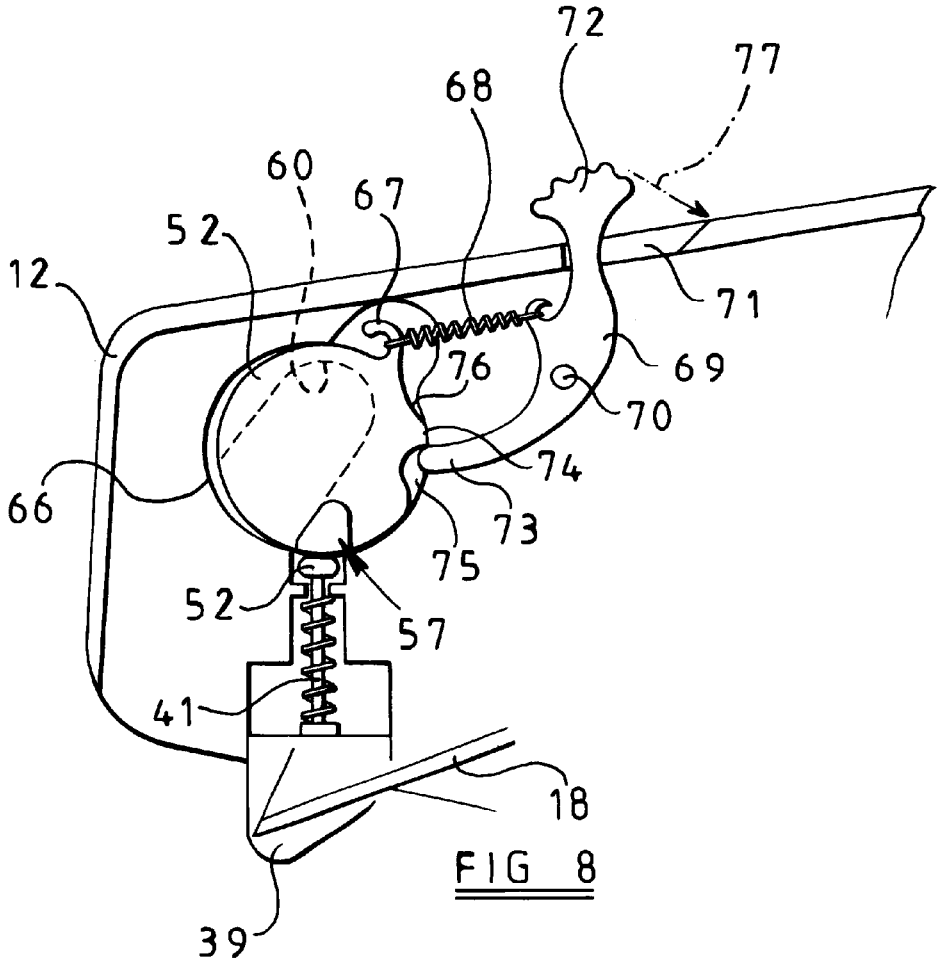
FIG 8

SAFETY KNIFE

BACKGROUND OF THE INVENTION

The invention relates to knives and particularly to safety knives of the kind where a part of a blade projects from a handle and there is provided a guard to shield the point and/or cutting edge of the blade so as to prevent or minimise the risk of accidental injury to a user of the knife.

In existing knives of this type, however, the guard for the blade is usually fixed and spaced from the blade so that the cutting edge of the blade is exposed. The object is to allow the exposed cutting edge to be applied to the material to be cut, while the fixed guard is intended to reduce the risk of a part of a person's body, or other surface or object, accidentally coming into contact with the exposed cutting edge when the knife is handled. Although such arrangements may reduce the risk of accidental injury or damage there is still some possibility of such injury or damage occurring since the exposed blade is still accessible, even though access to it is limited to a certain extent by the guard.

The present invention sets out to provide an improved form of safety knife where these disadvantages may be overcome.

SUMMARY OF THE INVENTION

According to the invention there is provided a safety knife comprising a handle, a blade mounted on the handle so that at least a portion of the blade projects from the handle, and at least one guard which is mounted on the handle for movement between an extended position where it overlies at least a part of the cutting edge of the blade, and a retracted position wherein said part of the cutting edge is exposed, resilient biasing means being provided to bias the guard towards the extended position.

Thus, during normal handling of the knife, the protective guard may be sufficient to prevent or reduce the risk of the projecting part of the blade accidentally cutting a person or damaging surfaces or materials, provided that the guard is not engaged with a force sufficient to overcome the resilient biasing means. At the same time, the more positive force which is likely to be applied in deliberate use of the knife for cutting will overcome the resilient bias acting on the guard, causing the guard to be displaced so that the cutting edge of the blade contacts the material being cut. The guard may thus be of any desired size or shape and, since it is retractable it may completely overlie the whole of the projecting part of the blade so that none of the blade is exposed when the knife is not in use.

Preferably the guard is at least partly retractable into a recess in the handle as it moves from the extended position towards the retracted position.

Said resilient bias means may comprise a spring, such as a helical compression spring, mounted on the handle and engaging a part movable with the guard.

The guard may move from its extended position to its retracted position with translatory linear movement. Alternatively, the guard may move from its extended position to its retracted position by angular pivotal movement.

As previously mentioned, the guard, when in the extended position, may overlie substantially the whole of at least one side face of the portion of the blade which projects from the handle.

There may be provided on the handle adjustable stop means movable between a locking position, in which it prevents the guard from moving from its extended position, and a release position in which it permits movement of the guard from its extended position to its retracted position. The stop means may comprise an element which is movable, by operation of a manipulating member, from a locking position in which it obstructs movement of a part movable with the guard, to a release position in which it does not obstruct movement of said part. Said movable element may be rotatable from its locking position to its release position. Said manipulating member may comprise an operating lever connected to the rotatable element so that angular movement of the lever effects rotation of the rotatable element between its locking and releasing positions.

In one embodiment, the rotatable element may comprise a disc having a peripheral edge, a portion of which lies in the path of movement of a part movable with the guard when the disc is in its locking position, said peripheral edge being formed with a recess which lies in the path of movement of said part movable with the guard when the disc is rotated to its release position, so that said part may enter the recess and permit movement of the guard from its extended position to its retracted position.

Alternatively or additionally, the rotatable element may be formed with an abutment which lies in the path of movement of a part movable with the guard when the element is in its locking position and is moved out of said path of movement when the element is rotated to its release position.

In any of the above arrangements said movable element is preferably biased into its locking position by spring means.

In the case where the movable element is rotatable, said operating lever may be directly connected to the rotatable element. Alternatively, the operating lever may be mounted on the handle for pivotal movement separately from the rotatable element, and may have a part which is engageable with the rotatable element in a manner to rotate the element to its release position upon pivotal movement of the lever.

In any of the arrangements previously described, there are preferably provided two of said guards mounted on the handle on opposite sides of the portion of the blade which projects from the handle. In this case the two guards are preferably both controlled by a single movable element and manipulating member. The two guards may be connected together so as to move in unison.

Means may be provided for adjusting the position of each guard independently of the other. For example, means may be provided for locking one guard in a retracted position while the other guard remains movable from its extended position to its retracted position against the action of said resilient balancing means.

In any of the above arrangements there may be further mounted on the handle manually adjustable stop means for adjusting the distance which the guard may move from its extended position towards its retracted position. For example, the adjustable stop means may comprise a movable stop element mounted on the handle and formed with a plurality of recesses of different depths which may be selectively moved into the path of movement of a part movable with the guard, whereby the extent of permitted movement of the guard is determined by the depth of the recess which is brought into said path of movement. The part movable with the guard may comprise a pin extending laterally from the guard. In this case, the laterally extending pin may pass through a slot in the handle, so as to project to the exterior of the handle, said movable stop element being mounted on the exterior of the handle.

The movable stop element may be in the form of a rotatable disc, said recesses of different depths being spaced apart around the periphery of the disc.

BRIEF DESCRIPTION OF THE DRAWINGS

FIG. 7 is a part-view showing a possible modification to the knives- of FIGS. 1 and 6, FIG. 8 is an enlarged view of an alternative form of control mechanism for the knife of FIG. 7.

DETAILED DESCRIPTION OF THE PREFERRED EMBODIMENTS

Referring to FIGS. 1 to 4, the knife comprises a handle 10, formed from two overlying parts: a left part 11 and a right part 12. Each part is essentially a mirror image of the other, the two parts being pivotally connected together by a pivot pin 13 so that they may be swung from the open position shown in FIG. 1, where the parts are arranged at an angle to one another, to the closed position shown in FIGS. 2 and 3 where the two parts of the handle overlie one another.

Figure 2:
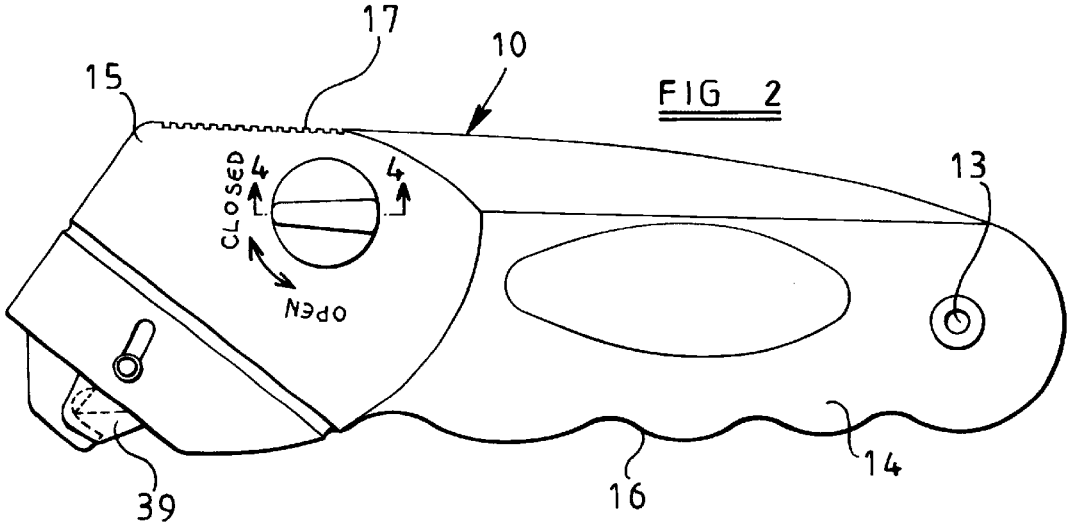
FIG. 2 is a similar view showing the knife in the closed position and ready for use.
Figure 3:
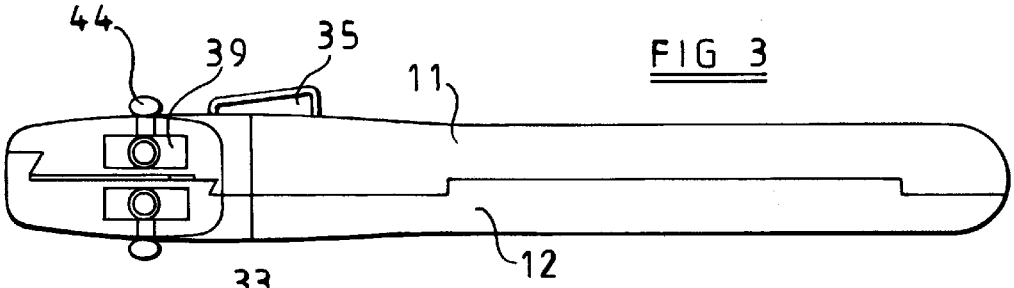
FIG. 3 is a view from below of the knife in the closed position.
Figure 4:
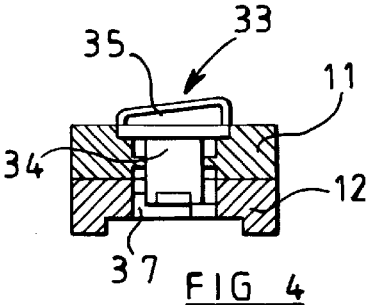
FIG. 4 is a section on the Line 4—4 of FIG. 2 showing the catch for securing the two halves of the knife together.

In the closed position shown in FIGS. 2 and 3 the shaped outer surfaces of the two parts of the handle provide a handgrip portion 14 and a head portion 15. The underside of the handgrip portion is shaped, as indicated at 16, to receive the user's fingers as the hand grips the knife, and an upper portion 17 is formed with transverse ribs against which the user's thumb may rest.

The knife comprises two operative blades: a trapezium shaped main blade 18 and a double-ended hooked blade 19 which acts as a fixed guard. Each blade is received in a shallow recess in the inner surface of the right handle part 12, so that the blades are clamped between the two halves of the knife handle when these are brought into overlying relationship.

Figure 1:
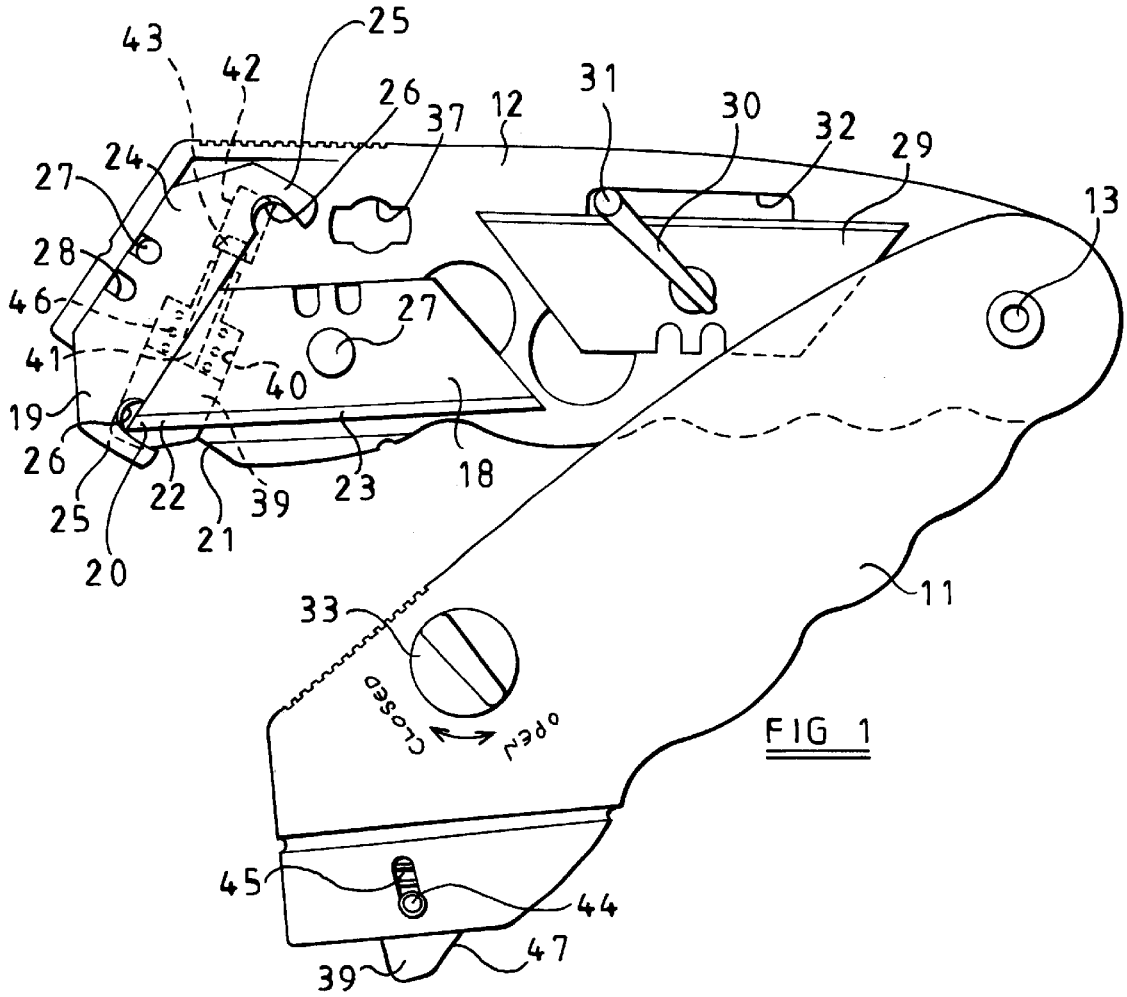
FIG. 1 shows a safety knife according to the present invention, shown in an open position.

As best seen in FIG. 1, the main trapezium shaped blade 18 is so located within the knife handle that a pointed end 20 of the blade projects beyond an inclined edge surface 21 of the handle so that the exposed portion 22 of the cutting edge 23 of the main blade extends at an obtuse angle to the edge 21 of the handle.

The hooked guard blade 19 is of the kind having a central portion 24 having two parallel unsharpened edges, opposite ends of the blade being formed with transverse tangs 25 extending approximately at right angles to the main axis of the blade. Concavely curved sharpened cutting edges 26 are formed between the tangs 25 and the main central portion of the blade 19. The two blades 18 and 19 are so located in relation to one another that one unsharpened main side edge of the blade 19 lies alongside an inclined end edge of the blade 18. One of the tangs 25 of the blade 19 is disposed outwardly beyond the exposed pointed extremity 20 of the main blade 18 so that the curved cutting edge 26 adjacent that tang extends around the point 20 of the main blade 18.

As will be seen from FIG. 1, the inclined unsharpened edge of the main blade 18 extends at approximately a right angle to the edge surface 21 of the handle, and the adjacent tang 25 on the guard blade 19 extends generally parallel to the surface 21.

The two blades may be located in the shallow recesses in the right part 12 of the handle, being closely embraced by those recesses. Alternatively or additionally, however, the right part 12 of the handle may be provided with projecting bosses, such as indicated at 27, which locate within one or more of the slots 28 conventionally provided in such blades, so as to assist in locating them.

Spare blades, indicated at 29, are stored within a suitably shaped recess within the handgrip part of the knife handle. This recess is deep enough to hold two or more blades stacked one-upon-the-other and a spring arm 30 is mounted to one side of the recess, as indicated at 3 1, and bears on the topmost spare blade so as to prevent the spare blades rattling when the handle is closed, or falling out of the recess when the handle is open. The mounting 31 is such as to allow the spring arm 30 to be swung to one side, and received in a recess 32, thus enabling a spare blade to be removed when required.

Figure 5:
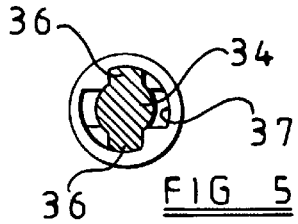
FIG. 5 is an end view of the catch shown in FIG. 4.

A quick release fastener 33 is provided to lock the two parts 11 and 12 of the handle together when they are in a overlying relationship. The construction of the fastener is shown in greater detail in FIGS. 4 and 5.

Referring to those figures, the fastener comprises a circular shaft 34 which is received in a hole in the left handle part 11 and is formed with a circular manipulating head 35. The lower end of the shaft 34 is formed with two diametrically opposed lugs 36 which cooperate with a shaped slot 37 in the right handle part 12. In one rotational position of the shaft 34 the lugs 36 may pass through the slot 37. The shaft is then turned clockwise through 90° bringing the lugs 36 into a position where they lie at right angles beneath the slot 37 thus locking the two halves of the handle together. When it is required to separate the two halves of the handle, the shaft 34 is rotated anticlockwise through 90°, bringing the lugs 36 into register with the slot 37. The shaft 34 may then be withdrawn axially out of the slot 37 so as to be disengaged from the slot allowing the two halves of the handle to be swung apart. The shaft 34 may be lifted by manually pulling on the manipulating head 35, or the shaft may be automatically biased upwardly by a spring, for example by a helical compression spring (not shown) which encircles the shaft 34 between the underside of the manipulating head 35 and an annular abutment on the upper handle part 11.

The knife, when closed, may be used to cut sheet material, for example thick cardboard, by pulling the exposed portions of the blades 18 and 19 over the edge of the sheet material and drawing the knife towards the user so that the cutting edge of the exposed point 20 cuts into the material as it enters the slot between the tang 25 and the adjacent surface 21 of the knife handle. As the material passes the pointed part 20 of the main blade 18 it meets the concavely curved cutting edge 26 of the guard blade 19. The curved cutting edge 26 cuts any part of the thickness of the material which passes beyond the pointed tip 20 of the main blade 18 and which does not therefore become fully severed by the main blade.

Instead of drawing the exposed blades over an exposed edge of a material to be severed, the tang 25 may also be forced through the material at a location away from its edges, by using sufficient force, the knife being drawn towards the user once the tang has been plunged through the material. The knife is therefore particularly suitable for ripping open cardboard boxes, self-adhesive wrapping tape, paper sacks and the like, where it may not be possible to apply the knife to an exposed edge of the material to be cut. The knife may also be used for cutting other materials such as strapping, string or other similar packaging materials.

The arrangement of the two blades ensures that there is little risk of fibres or other particles from the material becoming jammed in the blade, as can often happen with other safety knife blade arrangements. Although, as explained above, it is desirable for the concave edge of the guard blade to be sharpened, so as to provide an auxiliary cutting action, the invention does not exclude arrangements where the guard blade is not sharpened, but simply comprises a blade-like element of substantially constant thickness and having an unsharpened edge around the pointed tip of the main blade.

As may be seen from FIGS. 1 and 2, the unsharpened outer edges of the blade 19 and tang 25 provide a safety guard around the pointed tip 20 of the main blade 18 thus preventing, or reducing the risk of, the user's finger, or other part of the body, coming into contact with the point 20 of the blade or the exposed portion 22 of its cutting edge. The knife can therefore be safely left lying around, or kept in a pocket, with little risk of accident, while at the same time always being ready for use.

According to the invention, the knife is also provided with spring-loaded guards 39 located on each side of the exposed portions of the blades 18 and 19.

Each guard 39 is slidable within a recess 40 formed in one of the parts 11, 12 of the knife handle. A rod 41 extends rearwardly from each guard 39 and extends through a narrow gap leading from the slot 40 to a smaller auxiliary recess 42. The extremity of the rod 41 within the recess 42 has an enlarged head 43 to limit the extent to which the guard 39 can project from the recess 40. During assembly the rod 41 is placed laterally into the gap so that the enlarged head 43 is received in the recess 42. The rod 41 and enlarged head 43 may be integrally moulded with the guard 39. Alternatively, the rod 41 may be screw-threaded, the enlarged head 43 comprising a nut in screw-threaded engagement with the end of the threaded rod, so that the extent to which the guard 39 projects from the recess 40 may be adjusted. Alternatively or additionally, the extent of movement of each guard 39 may be controlled by a laterally extending pin 44 on the guard which slides along a slot 45 in the associated handle part. A helical compression spring 46 encircles the rod 41 between the rear surface of the guard 39 and the end of the recess 40 so as to bias the guard 39 outwardly. Alternatively, a compression spring may be provided between the enlarged end 43 of the rod 41 and the end surface of the recess 42.

As may be seen from FIGS. 1 and 2, each guard 39, when in the fully extended position, overlies the exposed portions of the cutting edges of both the main blade 18 and the guard blade 19. As the blades are drawn over the cardboard or other material being cut, the material passing into the slot between the tang 25 and the surface 21 engages the inclined edges 47 of the two guards 39 and forces the guards back into their respective recesses 40, against the action of the springs 46, so that the material engages the cutting edges of the blades.

The force necessary to retract the guards 39 may be increased or decreased by varying the angle of inclination of the edges 47, and/or varying the strength or compression of the springs 46.

The guards 39 increase the safety of the knife and reduce the risk of a user's finger or other body part engaging the cutting edges of the blades, since they prevent the user's finger or other body part from contacting the side faces of the exposed part of the blades, which might otherwise result in the user being cut, particularly if the pointed end 20 of the main blade does not happen to be exactly co-planar with the tang 25 on the guard blade 19. The guards also reduce the risk of clothing becoming snagged on the blades.

The shape of the guards 39 is so chosen in relation to their direction of sliding movement that it is unlikely that a user's finger will press against the guards 39 in such a manner as to cause them to be pushed into their recesses 40 sufficiently to enable the finger to come into contact with the cutting edge of either blade. At the same time, the shape of the guards is such that they readily retract when the knife is used to cut cardboard or other sheet material since the guards are pushed directly into their slots as a result of their bearing directly on the surface of the sheet material being cut on either side of the cut.

In some cases it may be desirable for the width of the effective slot into which the sheet material passes to be matched to the thickness of the sheet material. In the arrangement shown in the drawings the effective width of the slot is the distance between the inner surface of the tang 25 and the adjacent edge surface 21 of the knife handle. While this distance as shown may be necessary for cutting thick card, it might improve the cutting of thinner card if the effective width of this slot were smaller. This effect could be achieved by permitting adjustment of the extent to which the guards 39 may be retracted into their recesses 40. In the arrangements shown the guards may retract fully into the slots so that they become flush with the edge surface 21 exposing the full width of the slot between the tang 25 and the surface 21. However, adjustment means may be provided so that, at the inward limit of their retracting movement, the guards 39 still project beyond the surface 21 but to a lesser extent. The effective width of the slot leading to the cutting edges of the blades is then effectively reduced to the distance between the inner edge of the tang 25 and the outer parts of the guards 39. Any convenient means may be employed for limiting the inward movement of the guards 39. For example, an adjustable abutment may be provided for engagement by the pin 44 to limit the distance which the pin 44 can move along the slot 45. Such an arrangement will be described below in relation to FIG. 7.

Alternatively, the rod 41 connected to each guard 39 may be extended rearwardly through the handle so as to be engageable with a sliding element within the handle which may be slid, by movement of an external manipulating button, into and out of a position where it lies in the path of movement of the end of the rod 41. Thus, when the element is in one position it may allow the guards 39 to be retracted fully, and when in an alternative position it may be engaged by the ends of the rods 41 so as to prevent retraction of the guards beyond a certain point. The surface of the element which is engaged by the ends of the rods 41 may be stepped or otherwise shaped so as to permit different amounts of movement of the rods, depending on the position of the element. By this means the arrangement may provide for a number of alternative degrees of retraction of the guards 39. Preferably, the arrangement is such that in a safety position of the sliding element it prevents any retraction of the guards 39, and locks the guards in a fully extended position.

Means may also be provided for fixedly locating the sliding guards 39 in alternative positions relative to the surface 21 and the tang 25. In this case the outer extremities of the guards 39 will be spaced inwardly of the inner edge of the tang 25, thus reducing the effective width of the gap into which the sheet material can be passed. A small region of the cutting edges of the two blades will therefore be exposed and the guards 39 will not be allowed to retract. Accordingly, they will be less effective than when they are retractable, but will still provide some reduction in the risk of a user being accidentally cut by the blades.

The present invention is not restricted to safety knives having the two blade arrangement shown in FIGS. 1–3, and is equally applicable to knives having only a single blade with a part of its cutting edge exposed. Thus in the arrangement of FIGS. 1–3 the second blade 19 could be omitted. In this case the cutting action will be effected solely by the exposed cutting edge of the blade 18, the exposed point 20 of the blade still being protected by the spring-loaded guard assemblies 38.

Figure 6:
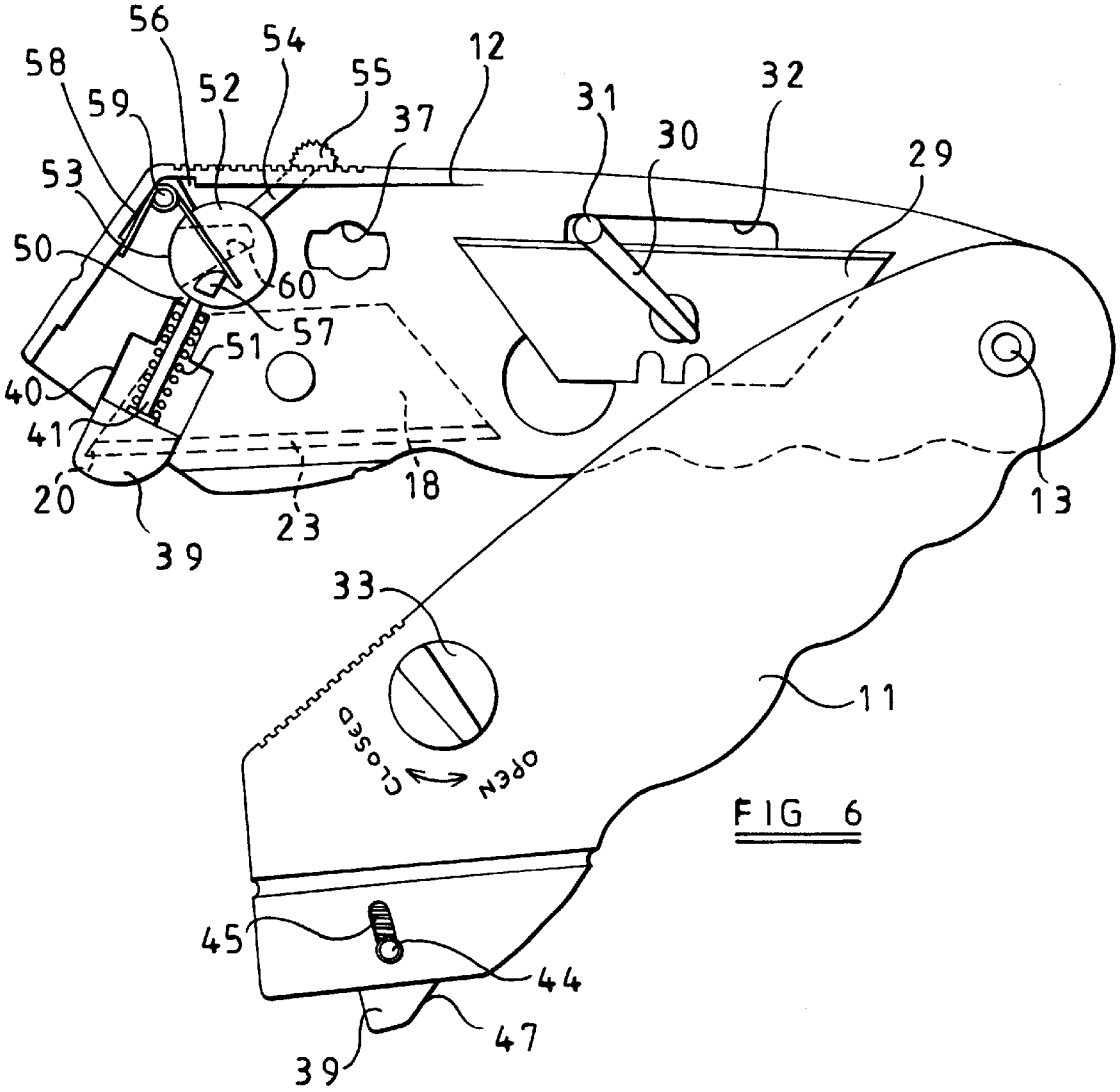
FIG. 6 is a similar view to FIG. 1 of an alternative form of safety knife according to the invention.

In the two-blade arrangement of FIGS. 1–3, the exposed tang 25 of the second blade 19 reduces the likelihood of a user's finger, or other part of the body, being pressed against the guard assemblies 38 in such a manner as to cause them to be retracted so that the finger can come into contact with the cutting edge of either blade. If the second blade 19 is omitted, there may a greater risk of this occurring and it is therefore preferable for means to be provided for locking the guard assemblies 38 fixedly in position on the knife, when the knife is not in use. FIG. 6 shows such an arrangement. Components which are common between FIGS. 1 and 6 bear the same reference numerals.

Referring to FIG. 6: as in the previous arrangement each guard 39 is slidable within a respective recess 40 formed in one part 11, 12 of the knife handle. A rod 41 extends rearwardly from each guard 39 and extends through a hole in an annular abutment 50 at the end of a reduced width portion of the recess 40. Each guard 39 is biased outwardly by a compression spring 51 which encircles the rod 41 between the guard 39 and abutment 50. In the fully extended position of each guard 39, as shown in FIG. 6, the end of the rod 41 on the guard which is mounted in the knife part 12 bears against the periphery of a circular disc 52 which is rotatably received in a part-circular recess 53 in the knife part 12. Alternatively or additionally the disc may have a central shaft, or journals, which are rotatable in small bearing recesses in the two halves of the knife blade. The disc 52 can be rotated through an angle by means of a lever 54 which is integral with the disc 52 and projects through a slot in the upper edge of the part 12 and carries at its extremity a manipulating button 55. The lever 54 is angularly slidable across a triangular recess 56 anti-clockwise from the locked position shown in FIG. 6 to an unlocked position where the lever 54 lies at the left hand side of the slot.

A generally triangular abutment 57 is formed on the surface of the disc 52 and is engaged by one arm of a spring 58 which is mounted on a circular boss 59 on the part 12 adjacent the disc 52. The spring 59 biases the disc 52 clockwise to the position shown in FIG. 6 where the lever arm 54 lies at the right hand end of the slot through which it passes.

When the disc 52 is in the rest position shown in FIG. 6 the abutment 57 on the outer surface of the disc is engaged by the end of the rod 41 which is connected to the guard 39 on the handle part 11. Accordingly, in this rest position both guards 39 are prevented from retracting into their respective recesses 40 and exposing the point 20 of the blade 18.

However, if the disc 52 is rotated anti-clockwise, against the action of the spring 58, by moving the lever 54 to the left, a recess 60 within the body of the disc 52 (as shown in dotted lines in FIG. 6) is brought into register with the end of the rod 41 on the part 12 and the abutment 57 is rotated out of engagement with the rod 41 on the guard 39 mounted on the part 11. Since the ends of the rods 41 are then no longer obstructed, both guards 39 are then free to be retracted into their respective recesses 40 in the blade handle by outside pressure.

Thus, when the knife is not in use, the guards 39 are held rigidly in their extended positions, as shown in FIG. 6, by the disc 52 and abutment 57. When the knife is to be used, the user pushes the lever 54, 55 along its slot so as to rotate the disc 52 anti-clockwise as seen in FIG. 6. This renders the guards 39 free to retract, but they remain extended, protecting the blade point 20, until the tip of the blade and the guards are drawn over the cardboard or other material to be cut. The pressure of the cardboard on the curved surfaces of the guards 39 causes the guards to retract, against the action of the springs 51, so that the point 20 of the blade 18 can enter and cut the cardboard or other material. When the knife is removed from the material, the springs 51 automatically extend the guards 39 to cover the blade tip 20 and the user releases the lever 54, 55 so that the spring 58 returns the lever and the disc 52 to the original rest position so as to prevent the guards 39 being retracted once more. In practice, the user can release the lever 54, 55 at any time while cutting is still taking place since the disc 52 will be prevented from rotating back to its rest position so long as the rod 41 lies within the recess 60 in the disc 52 and also by virtue of the abutment 57 bearing against the side of the rod 41 of the guard on the part 11 of the knife. It is only after the knife is removed from the material that the springs 51 will extend the guards 39 automatically so that the rods 41 withdraw from the disc 52, thus allowing the disc to snap back to its original rest position under the action of the spring 58.

In the arrangement of FIG. 6 the disc 52 is rotated from the locked position by the user pushing head 55 of the lever 54 forwards with his thumb. It will be appreciated, however, that by suitably modifying the disc 52 the device could be arranged to operate in the opposite sense so that the mechanism is moved from the locked position to the operative positive by drawing the lever back with the thumb.

Other mechanisms may be employed for locking or unlocking the guards 39. For example, as previously mentioned, the guards may be controlled by a sliding element within the handle which may be slid into and out of the path of movement of the rods 41.

The knife of FIG. 6 could also be modified to incorporate a hooked blade of the kind indicated at 19 in FIG. 1, where the sharpened tang at one end of the blade co-operates with the pointed end 20 of the blade 18. The hooked blade may be formed with cut-outs to accommodate the projection 57 on the disc 52. The arrangement may be such that when hooked blade is used engagement between the blade and the projection 57 holds the disc 52 in the position where the guards 39 can retract, so that the knife operates in a similar fashion to the version shown in FIG. 1. Then if the hooked blade is removed the disc 52 can revert to the position shown in FIG. 6 so that the guards 39 can be locked and the knife can operate in the manner described with respect to the form of the knife shown in FIG. 6, without a hooked blade.

As previously mentioned, in some uses of the knife it may be desirable for a smaller area of the tip 20 of the blade 18 to be exposed, when the guards are retracted, and this may be achieved by limiting the extent to which the guards 39 can be retracted to expose the tip of the blade. FIG. 7 shows an arrangement whereby the extent of retraction of the guards may be adjusted.

FIG. 7 shows a modified portion of the outer surface of the knife part 11. As in the arrangements of FIGS. 1 and 6, each guard 39 has an integral lateral pin 44 which slides along a slot 45 as the guard 39 is retracted and extended. In the modification of FIG. 7, which may be applied to both the FIG. 1 and the FIG. 6 arrangements, a disc 61 is rotatably mounted within a circular recess in the outer surface of the part 11. The disc 61 is integrally formed with an upstanding manipulating knob 62 and three slots 63, 64 and 65 which extend inwardly from the periphery of the disc 61 by different distances. The disc may be rotated to bring any of the three slots 63, 64, 65 into line with the slot 45 along which the pin 44 slides. A detent device may be provided on the disc 61 and/or the surrounding part 11 of the handle, so that the disc 61 can snap into each of the three positions where one of the slots is in line with the pin 44. For example, the periphery of the disc 61 may be formed with a "sprung pip" which can snap into any of three spaced recesses in the periphery of the circular recess in which the disc 61 rotates.

When the shortest slot 63 is in line with slot 45 the guard 39 on the part 11 can only be retracted by a short distance by virtue of the pin 44 striking the inner end of the slot 63. When the disc 61 is rotated to bring the longest slot 65 into line with the slot 45, then the guard 39 may be retracted to its full extent. The slot 64 provides an intermediate extent of retraction. It is only necessary to control the retraction of the guard 39 on one of the two parts 11, 12 of the knife, since if the distance by which one of the two guards can be retracted by pressure from the surface being cut is limited, then the surface will automatically push the other guard inwards by the same amount.

As previously described, when using the knife of FIG. 6, the user may release the lever 54, 55 at any time while cutting is still taking place so that after the knife is removed from the material the springs 51 extend the guards 39 automatically, allowing the disc and lever to snap back to their original rest position, under the action of the spring 58, so as once more to lock the guards 39 in their extended position.

Although this works well in practice, it is theoretically possible for the user to hold the lever 54, 55 in its forward position during the cut and even after the cut has been finished. If the user does this, it is possible for the knife to leave the material being cut with the guards 39 extended over the point of the blade, but still able to retract into the handle. If the guards were to strike against a part of the user's body in this condition, it is possible that they could retract under pressure so that the user is cut by the blade.

Although in practice this is a remote possibility, FIG. 8 shows diagrammatically an alternative arrangement whereby the guards 39 are automatically locked against retraction when the knife leaves the material being cut, regardless of the position of the operating lever. Parts in FIG. 8 which correspond to parts in FIG. 6 bear the same reference numerals.

Referring to FIG. 8: the disc 52 having the internal recess 60 is in this case rotatable in a slightly oval recess 66 in the body of the knife part 12.

Instead of an operating lever being connected directly to the disc 52, as in the FIG. 6 arrangement, the disc is formed with an anchor 67 for a helical tension spring 68 which is connected to a separate operating lever 69 which is pivotally mounted at 70 on the knife part 12. The upper end of the lever 69 extends through a slot 71 in the knife part 12 and is formed with a manipulating head 72. The lower end 73 of the pivoted lever 69 is engageable with a lobe 74 formed between two recesses 75 and 76 on the periphery of the disc 52.

FIG. 8 shows the rest position of the mechanism where the rods 41 on the guards 39 engage the periphery of the disc 52 and the underside of the abutment 57 respectively so that the guards are locked in the extended position where they protect the point of the blade 18.

When the user wishes to use the knife to perform a cut, he presses the guards 39 against the surface to be cut and draws the head 72 of the lever 69 back towards the rear of the slot 71, as indicated by the arrow 77. The consequent upward movement of the lower end 73 of the lever, in engagement with the lobe 74, rotates the disc 52 anti-clockwise so as to bring the recess 60 into register with the rod 41 on the guard 39 on the part 12, and to move the abutment 57 out of engagement with the end of the rod 41 on the knife part 11. The guards 39 are thus retracted into the knife body under the pressure exerted on the material to be cut. As the upper end of the lever 69 comes to the rear end of the slot 71 its lower end 73 snaps upwardly over the lobe 74 into the recess 76, with an audible snap, indicating to the user that the knife is ready to cut.

Should the user continue to hold the head 72 of the lever in its rearward position during the cut and after the knife has left the material, the disc 52 will still rotate clockwise, after the guards 39 have been automatically extended by the springs 52, back to the position shown in FIG. 8 so as to lock the guards 39 in the extended protective position. When the user wishes to use the knife again, it is necessary to release the head 72 of the lever 69 so that it moves forwards again under the action of the spring 68. The lower end 73 of the lever then snaps downwards over the lobe 74 back to the position shown in FIG. 8, this being permitted by the slight lateral movement of the disc 52 allowed by the slightly enlarged recess 66.

The arrangement therefore ensures automatic locking of the guards in the extended position, when the blade leaves the material being cut, even if the user retains the lever in its "ready to cut" position during and after making the cut.

If the user instead pushes the head 72 of the lever 69 forwards while making the cut, the lower end 73 of the lever will again snap downwardly over the lobe 74, this being permitted by the slight floating of the disc 52 and in this case, again, when the guards 39 are automatically extended when the blade leaves the material being cut the disc 52 will be rotated clockwise to the locking position under the action of the spring 68.

In the arrangement of FIG. 8 stop means are preferably provided to limit the extent of rotation of the disc 52. For example, the exposed surface of the disc 52 may be formed with a slot or recess which is engaged by a raised pip on the interior of the handle part 11, or vice versa. Alternatively, the anchor 67 on the disc 52 may be arranged to abut the surface on the handle part 12 when the disc 52 has reached the required clockwise limit of its rotation.

In another alternative arrangement, the periphery of the disc 52 may be integrally formed with an outwardly extending lever which passes through a slot through the peripheral wall on the handle part 12. Engagement of the lever with the ends of the slot then provide limits to the clockwise and anti-clockwise rotation of the disc 52 under the action of the lever 69 and the spring 68. An advantage of this latter arrangement is that the lever can act as a manual override to the automatic operation described in relation to FIG. 8, since the disc 52 may then be manually rotated anti-clockwise, by use of the lever, to the position where the guards 39 may retract.

As in the arrangement of FIG. 6, the disc 52 of FIG. 8 could also be mounted on a central axle rotatable in bearing recesses in the handle parts. In this case, however, an appropriate clearance is required between the axle and the recesses to enable the disc 52 to move laterally, as previously described.

As an alternative to the disc 52 being displaceable laterally in the arrangement of FIG. 6, in order to allow the lower end 73 of the lever 69 to snap downwards over the lobe 74, the lever 69 could be formed in two hinged parts so that the lower end 73 could deflect inwardly towards the main part of the lever 69, against the action of a spring, to enable the part 73 to snap over the lobe 74 without lateral movement of the disc 52.

Figure 9:
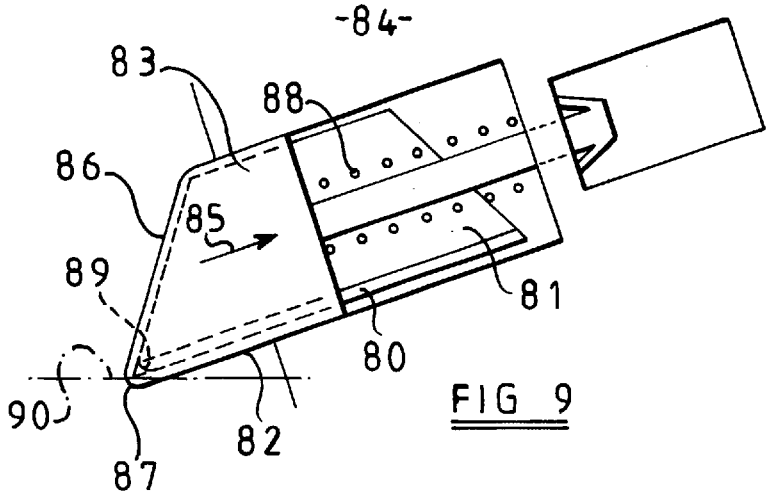
FIG. 9 is an enlarged view of the guard and blade of a further form of safety knife according to the invention.

FIG. 9 shows an enlarged view of a blade and associated guard or guards on a different form of knife.

In this case the cutting edge 80 of the blade 81 is generally parallel to one side edge 82 of a retractable guard 83. The guard 83 is retractable into the blade handle 84 in a direction, indicated at 85 which is generally parallel to the cutting edge of the blade. When part of the body of a person, or other object or material, accidentally strikes the guard 83, there is a high probability that the guard will be struck on the edge 82 which is parallel to the cutting edge of the blade or the inclined edge 86 which is adjacent an unsharpened edge of the blade. Impact on the edge 82 is unlikely to cause the guard 83 to retract since it will be generally at right angles to the direction of retraction. The guard will therefore remain in position to prevent the object striking the cutting edge 80 of the blade. If the object strikes the inclined edge 86 of the blade there is a greater possibility that the guard will be displaced since the striking force will have a greater component in the displacement direction. However, since the edge 86 is only, protecting an unsharpened edge of the blade this is less significant.

The object is therefore only likely to displace the guard and engage a sharpened part of the blade if it impacts on the apex 87 of the guard, and then only if it impacts with sufficient force to overcome the resistance provided by the biasing spring 88. This small risk can be further reduced by slightly rounding-off the point of the blade, as indicated at 89, if this is acceptable for the type of cutting which the blade is designed to do.

Although the guard 83 thus provides significant protection against accidental damage, when the knife is applied to a surface with a firm cutting action and in an appropriate orientation, the surface to be cut being indicated for example at 90, the guard or guards 83 will be forced back by the greater pressure exerted on the material so that the point and cutting edge of the blade can enter and cut the material.

In the arrangements described above the two guards are independently slidable and each guard has its own return spring. However, the invention includes within its scope arrangements where the guards are linked together, within or outside the handle, so that they move in unison. For example the two guards may be integral parts of a single movable guard member.

In the above-described arrangements, the guards which shield the blade are retracted into the handle with translatory linear movement, i.e. they slide into the handle without any change of orientation. However, this is not essential and the invention also includes within its scope arrangements where the orientation of the guards changes as they are retracted. In particular the guards may be pivotally mounted on the handle so that they swing into and out of the handle as they are retracted and extended.

Figure 10:
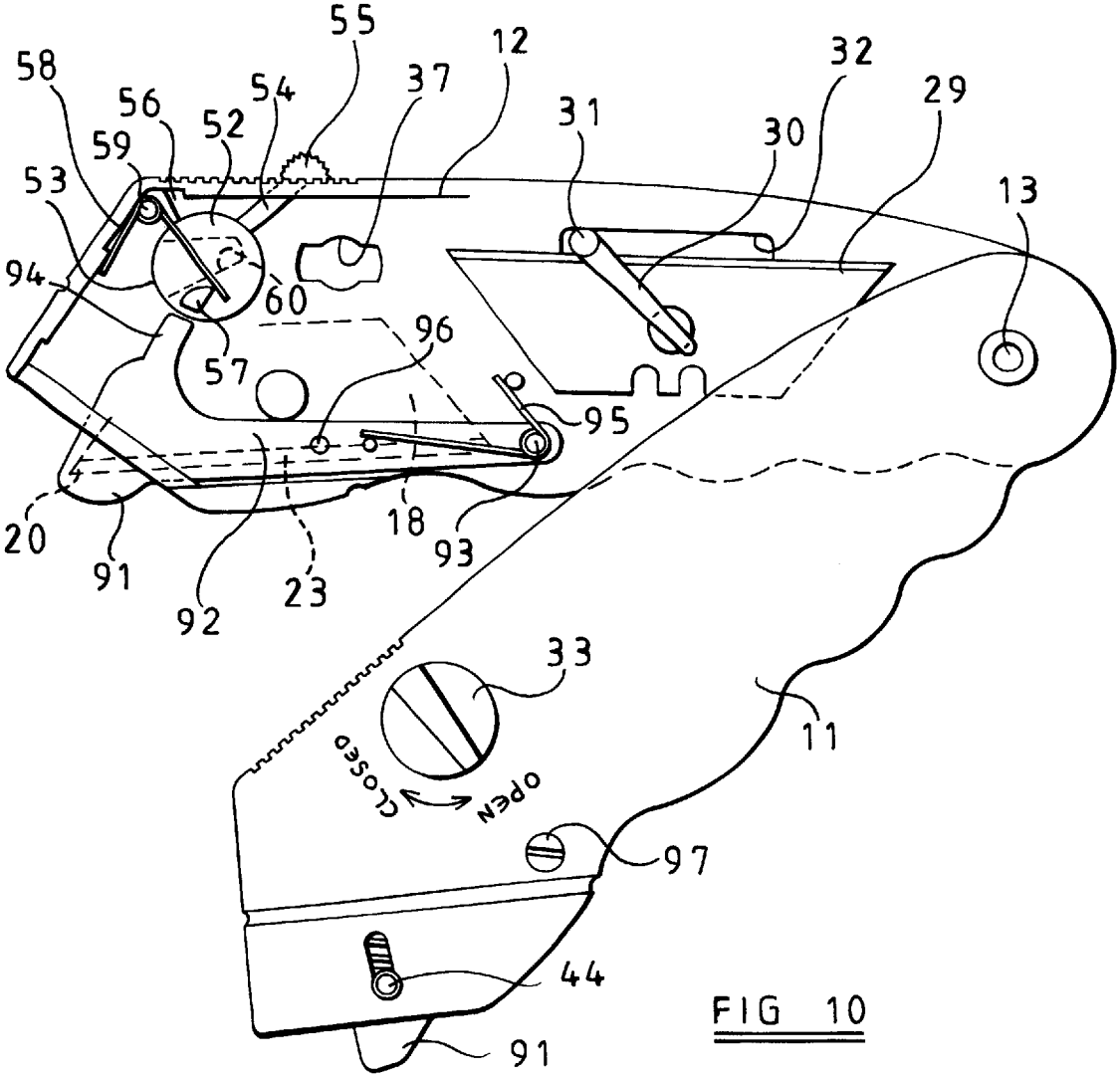
FIG. 10 is a similar view to FIGS. 1 and 6, showing a further embodiment.

Such an arrangement is shown in FIG. 10. This is a modified version of the knife shown in FIG. 6 and corresponding parts have the same references in the two figures. In FIG. 10, however, the sliding guards 39 of FIG. 6 are replaced by two pivotally mounted guards 91.

Each guard is formed on one end of a lever arm 92 which is pivotally mounted at 93 on the respective half of the blade handle. At the same end of the lever arm as the guard 91 there is formed a projection 94 which co-operates with the disc 52 in similar manner to the rods 41 on the sliding guards of FIG. 6.

Each lever arm 92 is biased outwardly by means of a two-armed spring 95 so that each guard 91 is normally in the extended position shown in FIG. 10. As in the previously described arrangements, the guard 91 on the handle part 12 is locked in the extended position by engagement of the projection 94 with the periphery of the disc 52, while the guard 91 on the other handle part 11 is locked in the extended position by engagement of its corresponding projection 94 with the abutment 57 on the surface of the disc 52.

When the disc 52 is rotated anti-clockwise by means of the lever 54, 55, the projection 94 on the lever arm on the part 12 can enter the recess 60 within the disc 52 and the corresponding projection on the lever arm on the handle part 11 can pass the abutment 57, so that both guards 91 can be retracted by pressure on them. The two guards 91 rotate about the pivots 93 against the action of the springs 95.

It will be appreciated that pivoted rather than sliding guards can be used in any safety knife according to the present invention. For example, the knife of FIG. 1, and particularly the knife of FIG. 8, could be modified to have pivoting rather than sliding guards.

For some purposes it may be desirable to have a fixed guard on one side of the projecting portion of the knife blade and a retracting guard on the other side. For example, when it is required to remove the top surface from a cardboard box, this may be done by holding the knife with the blade horizontal and resting the uppermost guard on the top edge of the box. The blade may then be pushed into the sidewall of the box, just below the top edge, the lower guard retracting under the pressure applied to the knife. The knife is then run around the periphery of the box so as to remove the top surface of the box as a flat panel or "lid". While the cut is being made the fixed upper guard bears against the upper surface of the box and serves as a guide so that the cut made by the blade is a small fixed distance below the upper surface. The upper guard can, if desired, be larger than the lower guard so that it extends over a greater area of the top surface of the box as it is run around its periphery.

In a knife of this kind, the upper guard can be permanently fixed and only the lower guard retractable according to the invention. However, in this case it may be necessary to manufacture a different form of the knife for use by a left-hander who will normally hold the knife in such a w ay that the other guard is uppermost. In order to avoid the necessity of manufacturing two forms of knife, therefore, both guards may be constructed so that they are retractable, according to the invention, but means may be provided to lock either guard in the extended position so that the knife can be used to cut the top surface from a box as described above.

Such an arrangement is shown in the knife of FIG. 10 where each lever arm 92 is formed with a hole 96 which may be engaged by a screw or other form of detent mounted on the handle part on which the lever arm is mounted. FIG. 10 shows a screw 97 on the handle part 11 which can be screwed into engagement with a hole 96 in the lever arm (not shown) mounted on the handle part 11 so as to lock that lever arm, and hence the corresponding guard 91 in the extended position. A similar screw (not shown) is provided on the outside of the handle part 12 to co-operate with the hole 96 in the lever arm 92 which is visible in FIG. 10.

The user of the knife may thus select which guard 91 is to be fixed in the extended position and which is to retract, depending on whether the user is left-handed or right-handed. When the knife is to be used for other purposes where it is desirable that both guards 91 should retract, then both screws 97 may be disengaged from the respective lever arms 92. It will be appreciated that, if desired, when the knife is not in use both screws 97 may be tightened to lock both guards 91 in the extended position. This renders the knife entirely safe for someone, such as a child, to pick up and handle even if the lever 54, 55 is accidentally operated.

The present invention relates only to the safety guards and other features of the handle in which the cutting blade or blades are mounted, and does not relate to the configuration of the cutting blades themselves. Although a two blade configuration is shown in FIGS. 1–3, by way of example, this is only an example of the many possible types of cutting blade, and cutting blade configurations, with which the features of the present invention may be used. The invention is not therefore intended to be limited to the use of any particular blade type or configuration, and the particular blade types and configurations shown in the drawings do not form a part of the present invention.

What is claimed is:

1. A safety knife comprising:

a handle;

a blade mounted on the handle so that at least a portion of the blade projects from the handle;

at least one guard mounted on the handle for movement between an extended position wherein the at least one guard overlies at least a part of the cutting edge of the blade, and a retracted position wherein said part of the cutting edge is exposed;

resilient biasing means for biasing the at least one guard towards the extended position; and an adjustable stop movable between a locking position, in which the stop prevents the at least one guard from moving from the extended position, and a release position in which the stop permits movement of the at least one guard from the extended position to the retracted position, the stop comprising a rotatable element that rotates by operation of a manipulating member from said locking position in which the stop obstructs movement of a guard part movable with the guard to said release position in which the stop does not obstruct movement of said guard part.

2. The safety knife according to claim 1, wherein the at least one guard is at least partly retractable into a recess in the handle as the at least one guard moves from the extended position towards the retracted position.

3. The safety knife according to claim 1, wherein said resilient biasing means comprise a spring mounted on the handle and engaging said guard part.

4. The safety knife according to claim 3, wherein the spring is a helical compression spring.

5. The safety knife according to claim 1, wherein the at least one guard moves from the extended position to the retracted position with translatory linear movement.

6. The safety knife according to claim 1, wherein the at least one guard moves from the extended position to the retracted position by angular pivotal movement.

7. The safety knife according to claim 1, wherein the at least one guard, when in the extended position, overlies substantially a whole of at least one side face of the portion of the blade which projects from the handle.

8. The safety knife according to claim 1, wherein said adjustable atop is biased into said locking position by spring means.

9. The safety knife according to claim 1, wherein the manipulating member comprises an operating lever connected to the rotatable element so that angular movement of the lever effects rotation of the rotatable element between said locking and release positions.

10. The safety knife according to claim 1, wherein the rotatable element comprises a disc having a peripheral edge, a portion of said peripheral edge lying in a path of movement of said guard part when the disc is in said locking position, said peripheral edge being formed with a recess which lies in the path of movement of said guard part when the disc is rotated to said release position, so that said guard part may enter the recess and permit movement of the guard from said extended position to said retracted position.

11. The safety knife according to claim 1, wherein the rotatable element comprises an abutment that lies in a path of movement of said guard part when the rotatable element is in the locking,position and is moved out of said path of movement when the rotatable element is rotated to the release position.

12. The safety knife according to claim 1, wherein said manipulating member is directly connected to the rotatable element.

13. The safety knife according to claim 1, wherein said manipulating member is mounted on the handle for pivotal movement separately from the rotatable element, and has a part which is engageable with the rotatable element in a manner to rotate the rotatable element to the release position upon pivotal movement of the manipulating member.

14. The safety knife according to claim 1, wherein there are two of said at least one guard mounted on the handle on opposite sides of the portion to the blade which projects from the handle.

15. The safety knife according to claim 14, wherein the two guards are both controlled by a single movable element and manipulating member.

16. The safety knife according to claim 15, wherein the two guards are connected together so as to move in unison.

17. A safety knife comprising:

a handle;

a blade mounted on the handle so that at least a portion of the blade projects from the handle;

two guards mounted on the handle on opposite sides of the said portion of the blade for movement between an extended position where they overlie at least a part of the cutting edge of the blade, and a retracted position wherein said part of the cutting edge is exposed;

resilient biasing means for biasing the two guards towards the extended position; and means for adjusting the position of each of said two guards independently of the other.

18. The safety knife according to claim 17, further comprising means for locking one of said two guards in an extended position, the other of said two guards remaining movable from the extended position to the retracted position against the action of said resilient biasing means.

19. A safety knife comprising, wherein the adjustable stop means comprise a movable stop element mounted on the handle and formed with a plurality of recesses of different depths which may be selectively moved into the path of movement of a part movable with the at least one guard, whereby the extent of permitted movement of the at least one guard is determined by a depth of the recess which is brought into said path of movement.

20. The safety knife according to claim 19, wherein the part movable with the at least one guard comprises a pin extending laterally from the at least one guard.

21. The safety knife according to claim 20, wherein the laterally extending pin passes through a slot in the handle, so as to project to the exterior of the handle, said movable stop element being mounted on the exterior of the handle.

22. The safety knife according to claim 21, wherein the movable atop element is in the form of a rotatable disc, said recesses of different depths being spaced apart, around a periphery of the disc.

* * * * *